US007226297B2

(12) United States Patent
Li

(10) Patent No.: US 7,226,297 B2
(45) Date of Patent: Jun. 5, 2007

(54) ELECTRICAL CONNECTOR

(75) Inventor: Chao-Chang Li, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/444,201

(22) Filed: May 31, 2006

(65) Prior Publication Data

US 2006/0270276 A1 Nov. 30, 2006

(30) Foreign Application Priority Data

May 31, 2005 (CN) ..... 2005 2 0072285

(51) Int. Cl.
*H01R 12/00* (2006.01)

(52) U.S. Cl. ..... 439/71; 439/607; 439/862

(58) Field of Classification Search ..... 439/70–71, 439/607, 680, 862
See application file for complete search history.

(56) References Cited

U.S. PATENT DOCUMENTS 5,975,959 A * 11/1999 Joly ..... 439/630
6,068,514 A * 5/2000 Zuin ..... 439/630
6,077,089 A * 6/2000 Bishop et al. ..... 439/66
6,905,344 B2 * 6/2005 Nishio et al. ..... 439/68
6,939,172 B2 * 9/2005 Lu ..... 439/607
7,077,663 B2 * 7/2006 Nishio et al. ..... 439/70

* cited by examiner

*Primary Examiner*—X. Chung-Trans
(74) *Attorney, Agent, or Firm*—Wei Te Chung

(57) ABSTRACT

An electrical connector (100) for receiving an electronic device, includes a shielding member (3), a terminal block (1) assembled on said shielding member (3), a plurality of terminals (2) received in the terminal block (1). Each terminal has a mating portion (23), an end portion (21) and a middle portion (22) connecting with the mating portion (23) and the end portion (21). The mating portion (23) and the end portion (21) of the terminal (2) are respectively located at two sides of the main body (11) of the terminal block (1) in the longitudinal direction, the end portions (21) of the adjacent terminals (2) are disposed at two opposite sides of the main body (11) of the terminal block (1), and the middle portion (22) of the terminals (2) is engaged with the terminal block (1).

12 Claims, 7 Drawing Sheets

ELECTRICAL CONNECTOR

BACKGROUND OF THE INVENTION

1. Field of the Invention

The present invention relates to an electrical connector, and particularly to an electrical connector used for a mobile phone or other electrical devices having different designs and configurations.

2. Description of the Prior Art

With the rapid development of the technology of wireless communication and advanced technology of electrics, the electrical consuming goods such as mobile phone, Personal Digital Assistant (PDA) etc., are designed to comply with miniaturization trend and multiple functions such as mounting a camera on thereof to meet with requirements of human. As a result, the requirement of socket connectors used in such equipments is correspondingly demanding.

Usually, these electrical connectors comprise two rows of contacts. Please with reference to the electrical connector as shown in the FIG. 1, the contact 2' comprises a soldering portion 25' projecting from the bottom of the insulative housing 10' and soldered onto the Print Circuit Board (PCB, not shown), a mating portion 22' resiliently bending from an end of the soldering portion 25' toward upwardly, a retaining portion 24' located on the other end of the soldering portion 25' and a connecting portion 23' connecting with soldering portion 25' and the retaining portion 24'. The retaining portion 24' is locked in the insulative housing 10' for holding the contact 2', and the mating portion 22 resiliently contacts with the conductive element 43' located on the bottom of the camera module 4'. However, the height of the contact 2' is too lager, and accordingly the connector with this contacts has a lager scale which goes against the trend of miniaturization. Whereas to pursue the aim of deceasing the height of contact excessively may result in lowering the resilient force, thus the electrical connection will be effected.

Hence, an improved electrical connector is desired to overcome the disadvantages of the prior art.

BRIEF SUMMARY OF THE INVENTION

Therefore, a main object of the present invention is to provide an electrical connector which has a plurality of lower profile and simple process contacts.

To fulfill the above-mentioned object, an electrical connector according to the present invention includes a shielding member accommodating an electronic device, a terminal block assembled to the shielding member, and a plurality of terminals received in the terminal block. Said contact comprises a mating portion, an end portion and a middle portion connecting with the mating portion and the end portion. The mating portion and the end portion of the contact are respectively arranged at two opposite sides of the terminal block, the end portions of the neighboring terminals are arranged at two opposite sides of the terminal block, and the middle portion of the terminal engages with the terminal block.

Other objects, advantages and novel features of the invention will become more apparent from the following detailed description when taken in conjunction with the accompanying drawings.

BRIEF DESCRIPTION OF THE DRAWINGS

The foregoing summary, as well as the following detailed description of the embodiments of the present invention, will be better understood when read in conjunction with the appended drawings. For the purpose of illustrating the invention, there are shown in the drawings embodiments which are presently preferred. As should be understood, however, the invention is not limited to the precise arrangements and instrumentalities shown. In the drawings.

DETAILED DESCRIPTION OF THE PREFERRED EMBODIMENT

Figure 1:
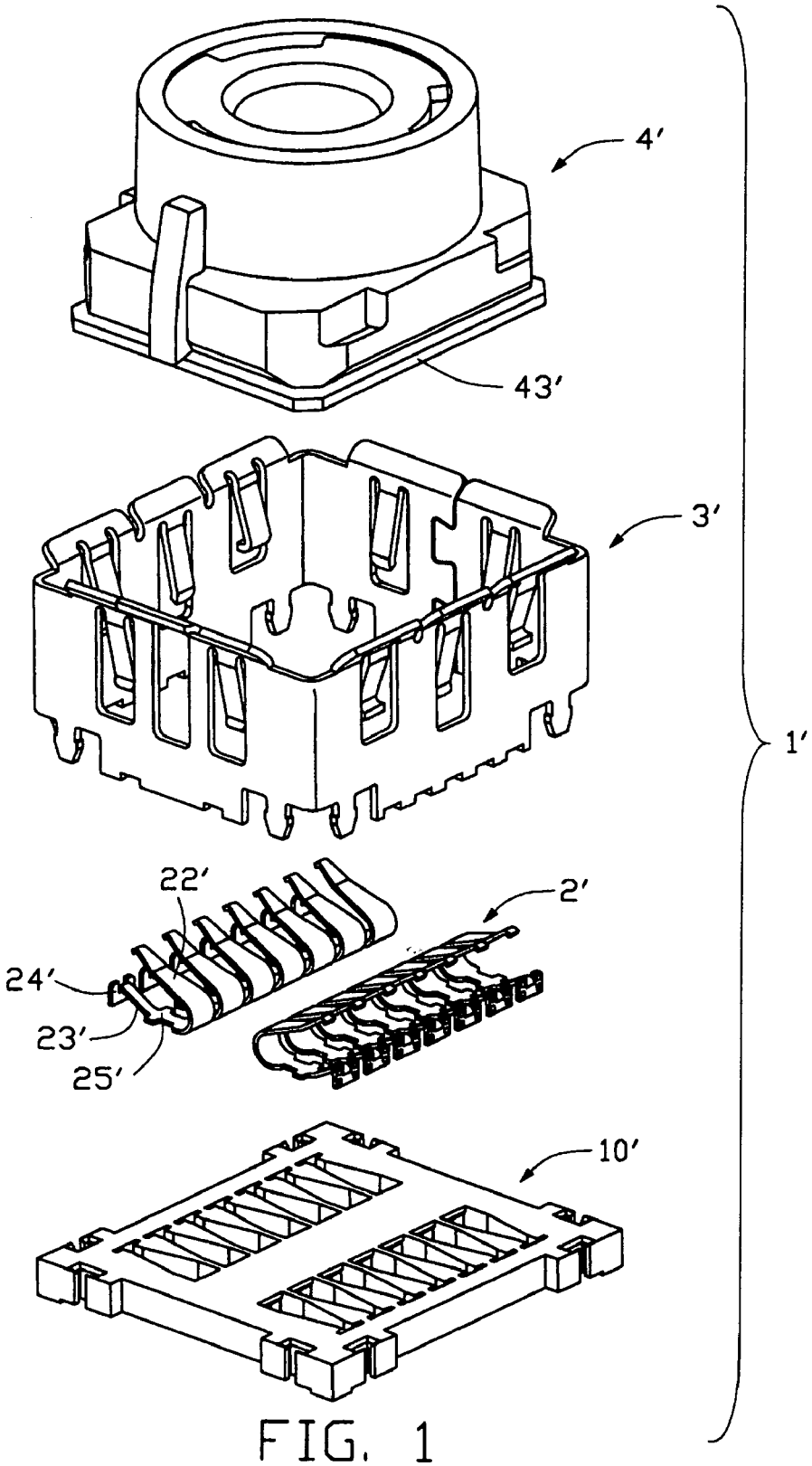
FIG. 1 (PRIOR ART)
FIG. 1 is an exploded view of a conventional electrical connector.
Figure 2:
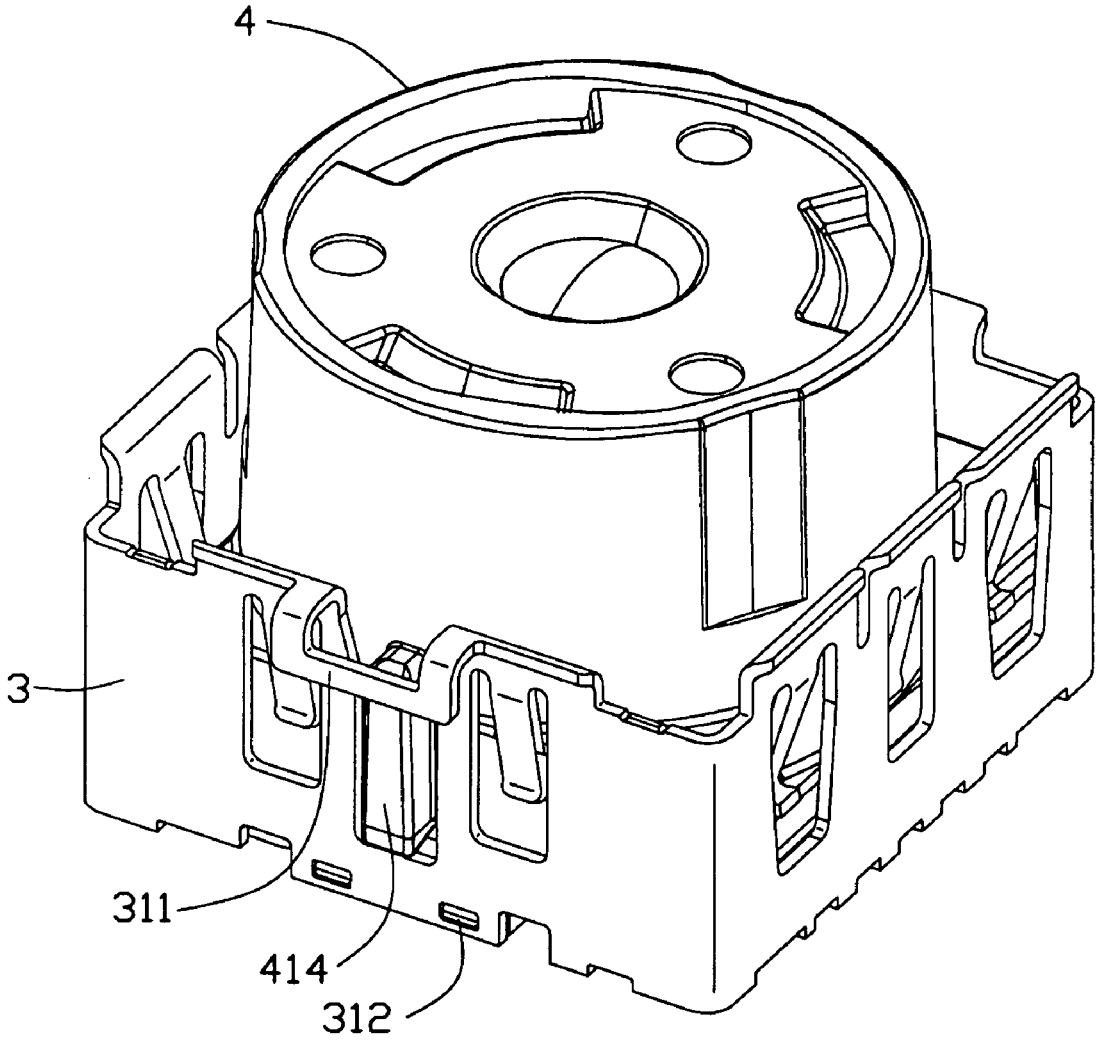
FIG. 2 is a perspective view of an electrical connector with an electrical device according to the present invention.
Figure 3:
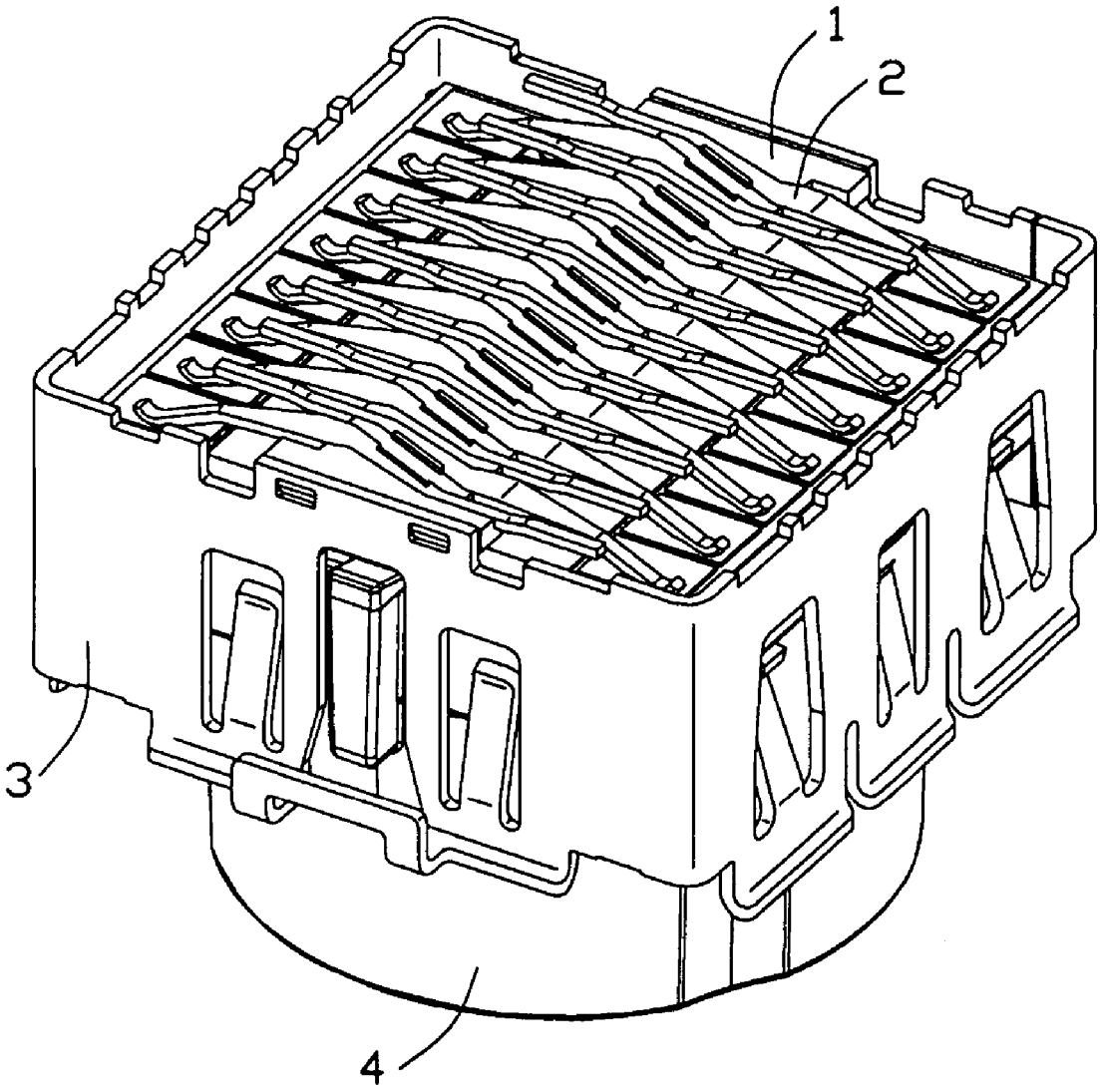
FIG. 3 is a view similar to FIG. 2, but viewed from another aspect.

Reference will now be made in detail to the preferred embodiment of the present invention.

Referring to FIGS. 2–7, an electrical connector 100 according to the present invention is adapted for receiving an electrical device and in this embodiment said electrical device is a camera module 4. The electrical connector 100 comprises a shielding member 3 accommodating said camera module 4, a plurality of terminals 2 and an insert-molding terminal block 1. The terminal block 1 is retained on the bottom of the shielding member 3.

The terminal block 1 includes a rectangular main body 11 and a pair of longitudinal side portions 13 respectively disposed at opposite ends of the main body 11. A plurality of passageways 15 are defined in a bottom of the main body 11 in the longitudinal direction, and a plurality of bulges 12 are located at the side ways of the passageways 15. Each side portion 13 comprises a pair of spaced projections 14 for coupling with the shielding member 3.

The terminal 2 with longitudinal configuration, comprises an end portion 21, a mating portion 23 and a middle portion 22 connecting with the end portion 21 and the mating portion 23 and being inserted molding with the terminal block 1. The mating portion 23 slantways extends upwardly from the middle portion 22, and includes an arc contacting portion 230 with pre-pressure at the free end thereof. The end portion 21 slantways extends downwardly from the middle portion 22 for mounting to a printed circuit board. The middle portion 22 is inclined to a certain extend, thus bottom of the terminal block 1 is inclinedly defined so as to engage with the middle portion 22 closely. The terminals 2 are received in terminal block 1 in a longitudinal direction, and the mating portion 23 and the end portion 21 are respectively located at two sides of the terminal block 1. Longer mating portion 23 can provide a longer force arm, and thus conductive contacts 2 can still provide a larger resisting force even if at a lower height when the contacting portion are pressed downwardly, so that the contacting portion 230 can reliably and electrically connect with the camera module 4. A plurality of terminals 2 are interlaced with one another, and the end portions 21 of the adjacent terminals 2 are disposed at two opposite sides of the terminal block 1 in order to prevent from short circuit caused by the shift of end portion 21 of the terminal 2. The bottom of the middle portion 22 defines a cuneal notch 220 which does not extend through the other side of the middle portion 22. Two adjacent terminals 2 are defined to a set of terminals and the notches 220 of said set of terminals 2 face to each other so as to make a reliable engagement with the terminal block 1 when the terminals are molded with the terminal block 1.

The shielding member 3 is firstly stamped from a metal sheet and then bent to form a rectangular configuration shown in the present invention. The shielding member 3 includes a first wall, a second wall, a third wall, a fourth wall 31, 32, 33, 34 which connect with each other in turn to form a receiving space 30. A swallow-tail shaped jointing line 300 is formed near to the jointing portion of the third wall 33 and the fourth wall 34. The first wall 31 comprises a cutout 310 defined on a central section thereof, a U-shaped connecting portion 311 protruding outwardly from the top of the first wall 31 corresponding to the cutout 310, a pair of resilient tabs 313 symmetrically located at two opposite sides of the cutout 310 respectively, a pair of apertures 312 defined on a low portion of the first wall 31 and a guide portion 314 which is formed at the free end of the first wall 31 and extends outside of the shielding member 3 and connects with the connecting portion 311. The cutout 310 includes a bottom edge 370. The U-shaped connecting portion 311 can overcome the limitation of the low intension caused by the cutout 310 located on the first wall 31. The second and the fourth walls 32, 34 each comprises a resilient tab 313 located on the central section thereof, two clasping arms 320 symmetrically located at two sides of the resilient tab 313 and three guide portions 314 respectively connecting with the resilient tab 313 and the clasping arm 320. The third wall 33 comprises a pair of resilient tabs 313, a pair of guide portions 314 connecting to the resilient tab 313 and a pair of apertures 312 located in the low portion of the third wall 33. The resilient tabs 313 of the four walls 31, 32, 33, 34 can symmetrically fix the camera module 4 and establish a grounding connection for the electrical connector 100. The clasping arms 320 of said wall 32, 34 can reliably lock the camera module 4 within the shielding member 3. The guiding portion 314 can easily guide the camera module 4 to be assembled into the shielding member 3.

Figure 4:
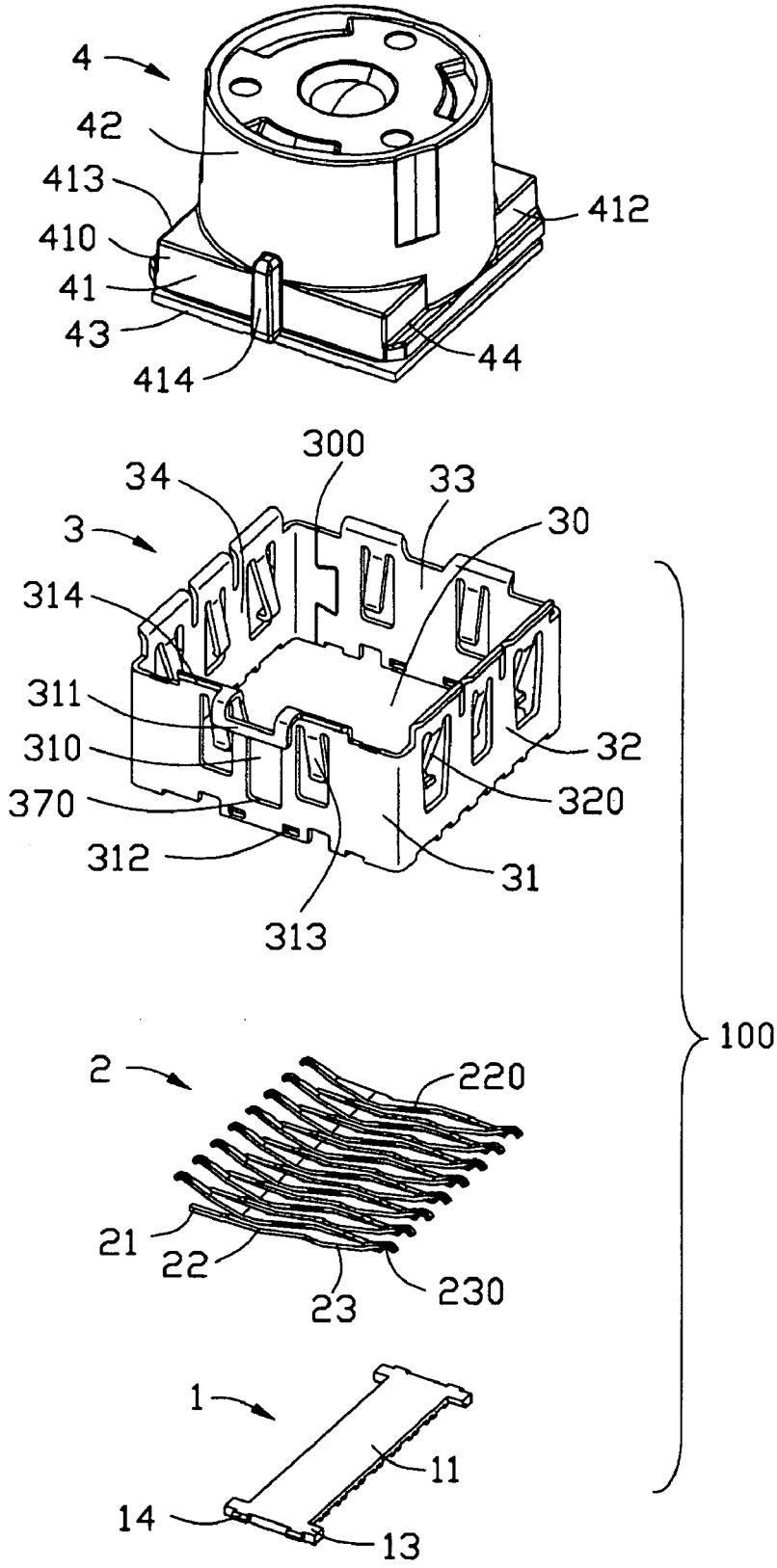
FIG. 4 is an exploded view of FIG. 2.

The camera module 4, received in the receiving space 30 of the shielding member 3, comprises a body portion 41, a columnar portion 42 situated on the top of the body portion 41 and a bottom portion 43 located beneath the body portion 41. The body portion 41 includes a front wall 410, two side walls 412, 413 adjoined to the front wall 410, and a back wall (not labeled) opposite to the front wall 410. The side walls 412, 413 each defines a ladder-shaped clasping notch 44 for locking with the clasping tab 320. Referring to FIG. 4, the front wall 410 of the body portion 41 provides an approximately longitudinal rib 414 which may insert into the cutout 310. When the camera module 4 is shocked, the rib 414 resists against the bottom 370 and is received in the U-shaped region of the connecting portion 311, so the camera module 4 will not move downwardly. A conductive layer enclosed around the columnar portion 42 can establish an electrical connection with the resilient tab 313 of the shielding member 3. The bottom surface 430 of the bottom portion 43 has a plurality of conductive pads 431 contacting with the mating portions 23 of the terminals 2.

Figure 5:
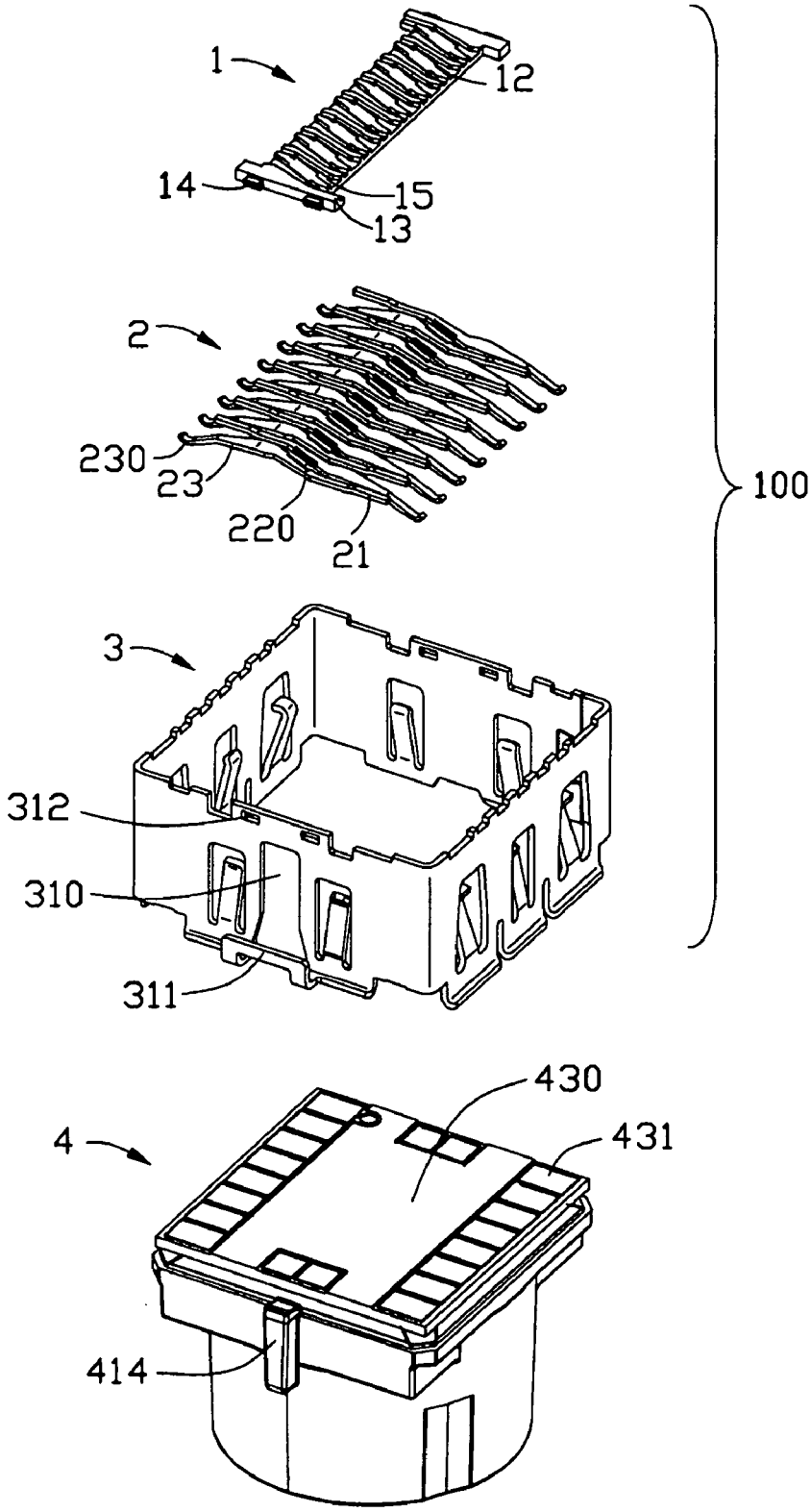
FIG. 5 is a view similar to FIG. 4, but viewed from another aspect.
Figure 6:
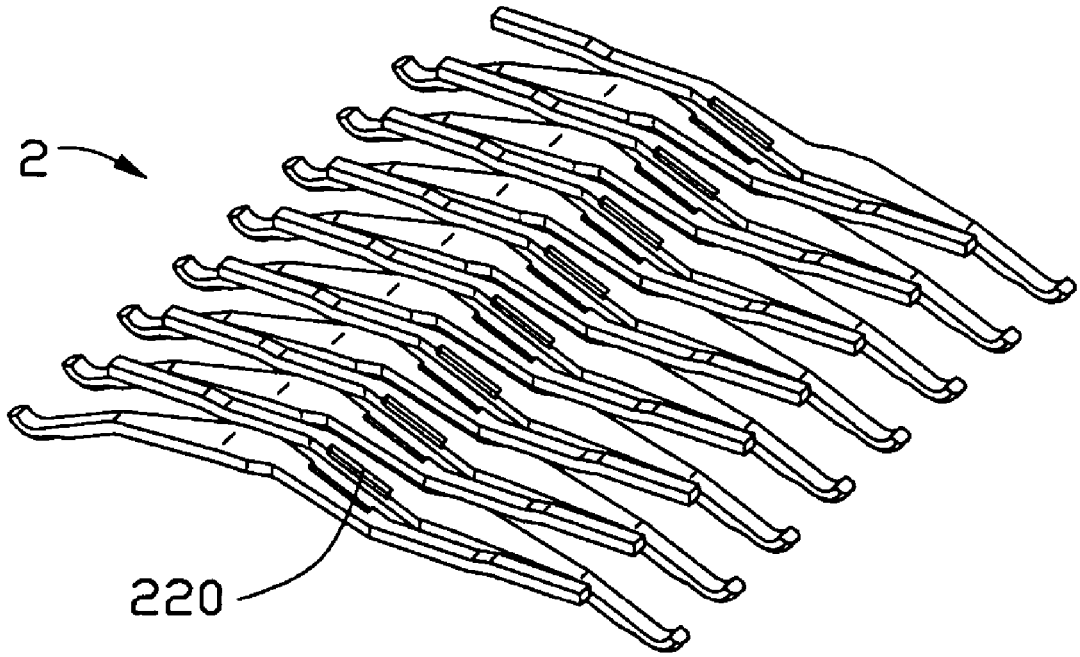
FIG. 6 is a perspective view of the terminals according to the present invention.
Figure 7:
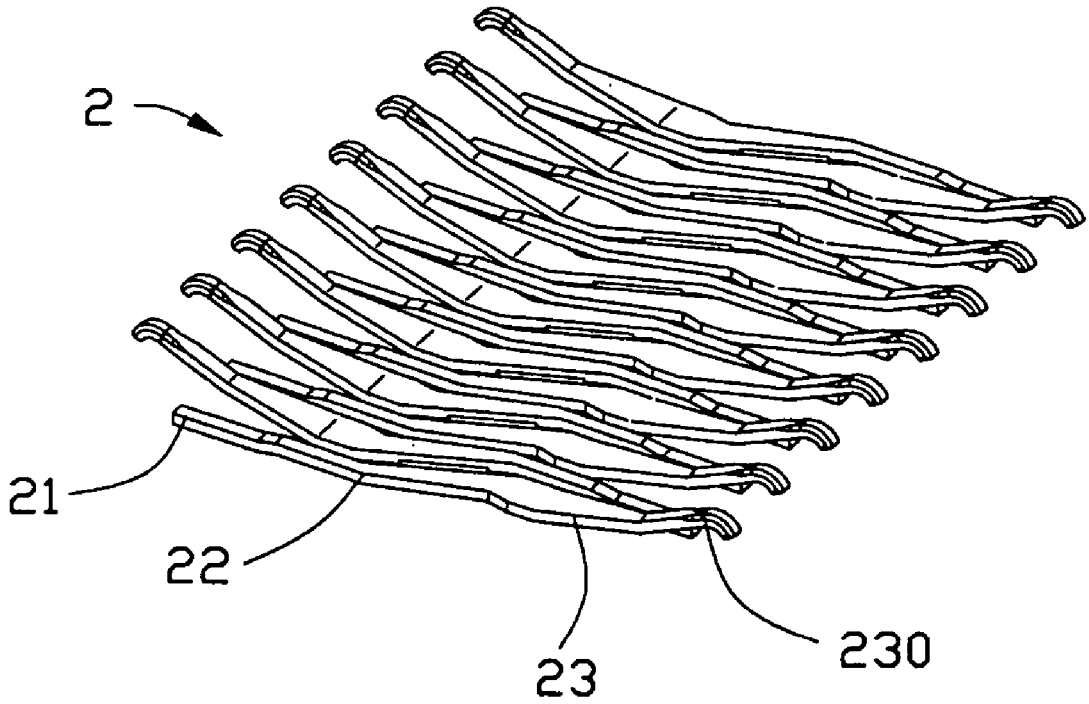
FIG. 7 is a view similar to FIG. 6, but viewed from another aspect.

In assembly, referring to FIGS. 4–5, firstly, the terminals 2 are arranged in the die, and then the melting plastic flows around the middle portions 22 of the terminals 2, the melting plastic is fully filled with the notch 220 then the terminal block 1 with a plurality of terminals assembled in is formed. The mating portions 230 of the terminals 2 extend upwardly from the main body 11 and the end portions 21 of the terminals 2 are beneath the main body 11. Then, the terminal block 1 with the terminals is assembled to the shielding member 3 with the projections 14 of the side portions 13 of the terminal block 1 received in the apertures 312. The camera module 4 is inserted into the receiving space 30 of the shielding member 3 along a top-to-bottom direction. In the meanwhile, the rib 414 of the camera module 4 is pressed into the cutout 310 of the shielding member 3 due to the pressure caused by the resilient tab 313 and the clasping arm 320. In the process of moving downwardly, the rib 414 engages with the cutout 310. The resilient tabs 313 press against the surface of the columnar portion 42, and the clasping arms 320 engage with the clasping notch 44. Thus, the camera module 4 is stopped and supported by shielding member 3, and can not be moved by shocking. After the camera module 4 is inserted, the conductive pads 421 of the bottom portion 43 of the camera module 4 electrically connect with the contacting portions 21 of the terminals 2 displaced in the terminal block 1. From a top view of said connector, the mounting section (21) extends in a first direction essentially perpendicular to the corresponding first side wall, the mating section (23) extends in a second direction opposite to said first direction and perpendicular to the corresponding third side wall opposite to said first side wall, under a condition that the retaining section (22) extends oblique to all four side walls so that the mating section (23) and the mounting section (21) of each corresponding terminal (2) are not aligned with each other along said first and second directions.

It is to be understood, however, that even though numerous, characteristics and advantages of the present invention have been set fourth in the foregoing description, together with details of the structure and function of the invention, the disclosed is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector for receiving an electronic device therein, comprising:

a shielding member;

a terminal block assembled on said shielding member and comprising a rectangular main body and a plurality of passageways defined in a bottom of the main body in the longitudinal direction; and a plurality of terminals received in said terminal block, each terminal having a mating portion, an end portion and a middle portion connecting with the mating portion and the end portion;

wherein the mating portion and the end portion of the terminal are respectively located at two sides of the main body of the terminal block in the longitudinal direction, the end portions of the adjacent terminals are disposed at two opposite sides of the main body of the terminal block, and the middle portion of the terminal is engaged with the terminal block.

2. The electrical connector as described in claim 1, wherein the mating portion slantways extends upwardly from the middle portion and forms a contacting portion at the end thereof, and the end portion slantways extends downwardly from the middle portion.

3. The electrical connector as claimed in claim 1, wherein each middle portion of the terminal defines a cuneal notch on one side thereof.

4. The electrical connector as claimed in claim 3, wherein two adjacent terminals are defined to a set of terminals and the notches of said set of terminals face to each other.

5. The electrical connector as described in claim 1, wherein said shielding member comprises first, second, third and fourth shielding walls connecting with each other in turns, and said terminal block engages with the first and the third shielding walls.

6. The electrical connector as claimed in claim 5, wherein the first and the third walls each defines an aperture engaging with the projection which is defined on the terminal block.

7. The electrical connector as claimed in claim 5, wherein the second and the fourth walls each comprises a resilient tab defined on the central section thereof and a pair of clasping arms symmetrically located at two sides of the resilient tab.

8. The electrical connector as claimed in claim 5, wherein the first shielding wall defines a cutout on a central section thereof, and the cutout further comprises a bottom edge.

9. The electrical connector as claimed in claim 8, wherein the electronic device defines a rectangular rib engaging with said cutout.

10. The electrical connector as claimed in claim 8, wherein the first shielding wall comprises an U-shaped connecting portion protruding outwardly from the top of the first wall corresponding to the cutout.

11. An electrical connector comprising:

a metallic shield defining four side walls commonly defining a cavity therein;

a terminal block received in a bottom portion of said cavity and including an insulative main body with a plurality of grooves formed in an undersurface thereof; and a plurality of terminals attached to the corresponding grooves, respectively, each of said terminals defines a mating section for mating with a module located in the cavity, a mounting section for mounting to a printed circuit board, and an intermediate retaining section which securing the terminal to the terminal block; wherein said terminals are divided with first and second groups alternatively arranged with each other along a lengthwise direction, under a condition that the retaining sections in both said first and second groups are located in a middle portion of the connector, the mating sections in the first group are located by one side of said middle portion while the mating sections in the second group are located by the other side of said middle portion, and oppositely the mounting sections in the first group are located by said other side of the middle portion while the mounting sections in the second group are located by said one side of the middle portion.

12. An electrical connector comprising:

a metallic shield defining, in turn, first, second, third and fourth side walls commonly defining a cavity therein;

a terminal block received in a bottom portion of said cavity and including an insulative main body with a plurality of grooves formed in an undersurface thereof; and a plurality of terminals attached to the corresponding grooves, respectively, each of said terminals defines a mating section for mating with a module located in the cavity, a mounting section for mounting to a printed circuit board, and an intermediate retaining section which securing the terminal to the terminal block; wherein from a top view of said connector, the mounting section extends in a first direction essentially perpendicular to the corresponding first side wall, the mating section extends in a second direction opposite to said first direction and perpendicular to the corresponding third side wall opposite to said first side wall, under a condition that the retaining section extends oblique to all four side walls so that the mating section and the mounting section of each corresponding terminal are not aligned with each other along said first and second directions.

* * * * *